US009872814B2

(12) United States Patent
Juto et al.

(10) Patent No.: US 9,872,814 B2
(45) Date of Patent: Jan. 23, 2018

(54) VIBRATION PATTERN FOR VIBRATION STIMULATION

(71) Applicant: CHORDATE MEDICAL AG, Zurich (CH)

(72) Inventors: Jan-Erik Juto, Stockholm (SE); Fredrik Juto, Stockholm (SE); William Holm, Stockholm (SE)

(73) Assignee: CHORDATE MEDICAL AG, Zurich (CH)

( * ) Notice: Subject to any disclaimer, the term of this patent is extended or adjusted under 35 U.S.C. 154(b) by 698 days.

(21) Appl. No.: 13/796,336

(22) Filed: Mar. 12, 2013

(65) Prior Publication Data

US 2013/0253388 A1 Sep. 26, 2013

Related U.S. Application Data

(60) Provisional application No. 61/613,359, filed on Mar. 20, 2012.

(30) Foreign Application Priority Data

Mar. 20, 2012 (EP) ..... 12160389

(51) Int. Cl.
*A61H 23/04* (2006.01)
*A61H 9/00* (2006.01)
(Continued)

(52) U.S. Cl.
CPC ..... *A61H 23/04* (2013.01); *A61H 9/0078* (2013.01); *A61H 21/00* (2013.01); *A61H 23/02* (2013.01);
(Continued)

(58) Field of Classification Search
CPC ..... A61H 9/0078; A61H 19/40; A61H 19/44; A61H 21/00; A61H 23/02; A61H 23/0263; A61H 23/04
See application file for complete search history.

(56) References Cited

U.S. PATENT DOCUMENTS 901,376 A 10/1908 Roberts
912,205 A 2/1909 Talcott
(Continued)

FOREIGN PATENT DOCUMENTS

EP 0935980 A1 8/1999
EP 2418231 A1 2/2012
(Continued)

OTHER PUBLICATIONS

Alstadhaug, "Migraine and the Hypothalamus", Cephalalgia, 2009, pp. 1-9.
(Continued)

*Primary Examiner* — Steven Douglas
*Assistant Examiner* — Kathrynn Lyddane
(74) *Attorney, Agent, or Firm* — Birch, Stewart, Kolasch & Birch, LLP

(57) ABSTRACT

A method of treatment by vibration stimulation is provided. The method includes providing an expandable stimulation member adapted to impart vibrations to body tissue of a human subject; introducing the stimulation member into a body cavity of the human subject; expanding the stimulation member to a volume such that the stimulation member abuts against body tissue within the body cavity; bringing the stimulation member to vibrate such that vibrations are imparted to the body tissue in the body cavity of the human subject according to a vibration pattern, wherein the vibration pattern includes a main periodic element of a first
(Continued)

frequency and an excitation stimulus of a second frequency higher than the first frequency.

12 Claims, 5 Drawing Sheets

(51) Int. Cl.
*A61H 21/00* (2006.01)
*A61H 23/02* (2006.01)

(52) U.S. Cl.
CPC . *A61H 23/0263* (2013.01); *A61H 2201/0103* (2013.01); *A61H 2201/50* (2013.01); *A61H 2201/5005* (2013.01); *A61H 2201/5056* (2013.01); *A61H 2205/023* (2013.01); *A61H 2230/04* (2013.01); *A61H 2230/08* (2013.01); *A61H 2230/10* (2013.01)

(56) References Cited

U.S. PATENT DOCUMENTS

| | | | | |
|---|---|---|---|---|
| 961,034 | A | 6/1910 | Siebert et al. | |
| 1,735,519 | A | 11/1929 | Vance | |
| 1,764,838 | A | 6/1930 | Horne | |
| 2,052,321 | A | 8/1936 | Smart | |
| 2,101,273 | A | 12/1937 | Smith | |
| 3,612,211 | A | 10/1971 | Clark, III | |
| 3,848,607 | A | 11/1974 | St. Clair | |
| 4,462,411 | A | 7/1984 | Rickards | |
| 4,911,149 | A | 3/1990 | Borodulin et al. | |
| 5,139,510 | A | 8/1992 | Goldsmith, III et al. | |
| 5,609,606 | A | 3/1997 | O'Boyle | |
| 5,682,881 | A | 11/1997 | Winthrop et al. | |
| 5,903,516 | A | 5/1999 | Greenleaf et al. | |
| 6,159,170 | A | 12/2000 | Borodulin et al. | |
| 6,193,680 | B1 | 2/2001 | Parsons et al. | |
| 6,358,272 | B1 | 3/2002 | Wilden | |
| 6,514,237 | B1 | 2/2003 | Maseda | |
| 7,628,744 | B2 * | 12/2009 | Hoffman | A61B 5/0002 128/905 |
| 8,317,816 | B2 | 11/2012 | Becker | |
| 9,132,058 | B2 * | 9/2015 | Imboden | A61H 19/00 |
| 2001/0049466 | A1 | 12/2001 | Leysieffer et al. | |
| 2001/0051819 | A1 | 12/2001 | Fischell et al. | |
| 2002/0072781 | A1 | 6/2002 | Lattner et al. | |
| 2002/0177889 | A1 | 11/2002 | Brisken et al. | |
| 2003/0087734 | A1 | 5/2003 | Kring et al. | |
| 2004/0097850 | A1 | 5/2004 | Plante | |
| 2004/0172112 | A1 | 9/2004 | Cioanta et al. | |
| 2004/0230252 | A1 | 11/2004 | Kullok et al. | |
| 2004/0243172 | A1 | 12/2004 | Hogle | |
| 2005/0011518 | A1 | 1/2005 | Biondo et al. | |
| 2005/0021092 | A1 * | 1/2005 | Yun | A61N 1/326 607/3 |
| 2005/0054958 | A1 | 3/2005 | Hoffmann | |
| 2005/0165439 | A1 | 7/2005 | Weber et al. | |
| 2006/0094992 | A1 | 5/2006 | Imboden et al. | |
| 2006/0190022 | A1 | 8/2006 | Beyar et al. | |
| 2007/0149905 | A1 | 6/2007 | Hanna | |
| 2008/0198330 | A1 | 8/2008 | Taylor | |
| 2008/0200848 | A1 | 8/2008 | Avni | |
| 2008/0208168 | A1 * | 8/2008 | Garabet | A61M 31/00 604/514 |
| 2008/0281238 | A1 | 11/2008 | Oohashi et al. | |
| 2009/0005713 | A1 | 1/2009 | Podrazhansky et al. | |
| 2009/0187098 | A1 | 7/2009 | Makower et al. | |
| 2009/0259315 | A1 | 10/2009 | Banik | |
| 2010/0004709 | A1 | 1/2010 | Mische | |
| 2010/0094209 | A1 | 4/2010 | Drasler et al. | |
| 2010/0228075 | A1 | 9/2010 | Lu | |
| 2010/0234840 | A1 | 9/2010 | Jackson et al. | |
| 2010/0249637 | A1 | 9/2010 | Walter et al. | |
| 2010/0274164 | A1 * | 10/2010 | Juto | A61H 9/0078 601/46 |
| 2010/0286576 | A1 | 11/2010 | Pryor et al. | |
| 2010/0312322 | A1 | 12/2010 | Eidenschink et al. | |
| 2011/0190668 | A1 | 8/2011 | Mishelevich | |
| 2011/0270138 | A1 | 11/2011 | Mishelevich | |
| 2013/0041299 | A1 * | 2/2013 | Lacy | A61H 21/00 601/46 |

FOREIGN PATENT DOCUMENTS

| | | | |
|---|---|---|---|
| GB | 385992 | A | 1/1933 |
| GB | 1217760 | A | 12/1970 |
| JP | 2001-17500 | A | 1/2001 |
| JP | 2001-37883 | A | 2/2001 |
| KR | 10-1019957 | B1 | 3/2011 |
| RU | 2099039 | C1 | 12/1997 |
| RU | 2199303 | C1 | 2/2003 |
| SU | 1148614 | A | 4/1985 |
| SU | 1560205 | A1 | 4/1990 |
| WO | WO 86/01399 | A1 | 3/1986 |
| WO | WO 96/36396 | A2 | 11/1996 |
| WO | WO 96/39218 | A1 | 12/1996 |
| WO | WO 01/41695 | A2 | 6/2001 |
| WO | WO 2004/047675 | A2 | 6/2004 |
| WO | WO 2004/105579 | A2 | 12/2004 |
| WO | WO 2006/114783 | A2 | 11/2006 |
| WO | WO 2008/138997 | A1 | 11/2008 |
| WO | WO 2009/020648 | A1 | 2/2009 |
| WO | WO 2010/033055 | A1 | 3/2010 |
| WO | WO 2011/005165 | A1 | 1/2011 |
| WO | WO 2012/055436 | A1 | 5/2012 |

OTHER PUBLICATIONS

Ansarinia et al., "Electrical Stimulation of Sphenopalatine Ganglion for Acute Treatment of Cluster Headaches", Headache, vol. 50, Jul. 2010, pp. 1164-1174.

Bar-Shir et al., "Late Stimulation of the Sphenopalatine-Ganglion in Ischemic Rats: Improvement in N-Acetyl-Aspartate Levels and Diffusion Weighted Imaging Characteristics as Seen by MR", Journal of Magnetic Resonance Imaging, vol. 31, 2010, pp. 1355-1363.

Brown et al., "Towards a Physiology-Based Measure of Pain: Patterns of Human Brain Activity Distinguish Painful from Non-Painful Thermal Stimulation", Plos One, vol. 6, Iss. 9, e24124, Sep. 2011, pp. 1-8.

Carpi et al., "Folded dielectric elastomer actuators," Smart Materials and Structures, vol. 16, 2007, pp. S300-S305.

Carpi et al., "Millimetre-scale bubble-like dielectric elastomer actuators," Polymer International, vol. 59, 2010 (published online Dec. 18, 2009), pp. 407-414.

Jung et al., "A self-sensing dielectric elastomer actuator," Sensors and Actuators A, vol. 143, 2008, pp. 343-351.

Kim et al., "Predicting the Timing of Spikes Evoked by Tactile Stimulation of the Hand", J Neurophysiol, vol. 104, 2010, pp. 1484-1496.

Klinger et al., "Untersuchungen zur Mikro-zirkulation der Nasenschleimhaut bei Verwendung von Ballon-tamponaden", Laryngo-Rhino-Otol., vol. 76, 1997, pp. 127-130, XP008066107.

Krajnak et al., "Characterization of Frequency-Dependent Responses of the Vascular System to Repetitive Vibration", JOEM, vol. 52, No. 6, Jun. 2010, pp. 584-594.

Kuncel et al., "Selection of Stimulus Parameters for Deep Brain Stimulation", Clinical Neurophysiology, vol. 115, 2004, pp. 2431-2441.

Leroux et al., "Cluster Headache", Orphanet Journal of Rare Diseases, vol. 3, No. 20, 2008, pp. 1-11.

Ludwig, "The Velocity of Sound through Tissues and the Acoustic Impedance of Tissues", the Journal of the Acoustical Society of America, vol. 22, No. 6, Nov. 1950, pp. 862-866.

Malm, "Measurement of Nasal Patency", Allergy, vol. 52 (suppl. 40), 1997, pp. 19-23.

Malm, "Stimulation of Sympathetic Nerve Fibres to the Nose in Cats", Acta Otolaryng, vol. 75, 1973, pp. 519-526.

(56) References Cited

OTHER PUBLICATIONS

Papon et al., "Nasal wall compliance in vasomotor rhinitis," J. Appl. Physiol., vol. 100, 2006 (First published Sep. 1, 2005), pp. 107-111, XP055055268.
Pelrine et al., "Electrostriction of polymer dielectrics with compliant electrodes as a means of actuation," Sensors and Actuators A, vol. 64, 1998, pp. 77-85.
Salansky et al., "Responses of the Nervous System to Low Frequency Stimulation and EEG Rhythms: Clinical Implications", Neuroscience and Biobehavioral Reviews, vol. 22, No. 3, 1998, pp. 395-409.
Tepper et al., "Acute Treatment of Intractable Migraine With Sphenopalatine Ganglion Electrical Stimulation", Headache, vol. 49, Jul. 2009, pp. 983-989.
VBM, "VBM Tube Fixations", VBM Medizintechnik GmbH, 2006, 6 pages provided.
Zelena, "Nerves and Mechanoreceptors: The Role of Innervations in the Development and Maintenance of Mammalian Mechanoreceptors", Springer, 1994, pp. 147-148.
Zhang et al., "Dielectric Elastomers in Actuator Technology," Advanced Engineering Materials, vol. 7, No. 5, 2005, pp. 361-367.

* cited by examiner

VIBRATION PATTERN FOR VIBRATION STIMULATION

CROSS-REFERENCE TO RELATED APPLICATIONS

This application claim priority under 35 U.S.C. § 119(e) to U.S. Provisional Application No. 61/613,359 filed on Mar. 20, 2012. This application also claims priority under 35 U.S.C. § 119(a) to Application No. 12160389.8, filed in Europe on Mar. 20, 2012. The entire contents of each of the above-identified applications is expressly incorporated herein by reference.

BACKGROUND OF THE INVENTION

1. Technical Field

The present invention generally relates to devices and methods for imparting vibrations to a body tissue of a subject and, in particular, to vibration patterns for such devices and methods.

2. Description of Background Art

Vibrations are registered in the mammalian body by mechanoreceptors. There are four main types of mechanoreceptors in the human body: Pacinian corpuscles, Meissner's corpuscles, Merkel's discs, and Ruffini corpuscles that are responsible for detection and communication of mechanical influence. Pacinian corpuscles (also known as lamellar corpuscles) detect rapid vibrations (200-300 Hz). Meissner's corpuscles (also known as tactile corpuscles) on the other hand detect changes in texture (vibrations around 50 Hz) and adapt rapidly. Merkel's discs (also known as Merkel nerve endings) detect sustained touch and pressure and adapt slowly. Ruffini corpuscles (also known as Ruffini's end organs, bulbous corpuscles, and Ruffini endings) are slowly adapting receptors that detect tension deep in the skin. Most studies of mechanoreceptors have been performed on the skin.

Pacinian corpuscles are distributed in connective tissue in various parts of the mammalian body; e.g. in skeletal muscles, in ligaments, in joint capsules, in the periosteum and beneath the interosseous membranes, in the epineurium, in the adventitia of blood vessels, in the pancreas, in the pleura, in the mesentery and in the mesocolon. They are also found in the mammalian skin, where they are localized in the corium and thus deeper than other dermal receptors. In addition, they are densely distributed under the volar surface of the human hand (Zelena J., *Nerves and mechanoreceptors: the role of innervations in the development and maintenance of mammalian mechanoreceptors*: p. 147 Springer 1994).

Vibration stimulation can be used for various kinds of medical treatment. One example of a vibration device is disclosed in WO 2008/138997. This PCT publication discloses a device for vibration stimulation in a body cavity, such as the nasal cavity or the intestine, of a patient. The device comprises a stimulation member and a vibration generator adapted to bring the stimulation member to vibrate. The device can be arranged in a first state, in which the stimulation member can be introduced via a body opening into a body cavity and a second state, in which the stimulation member is expanded to a volume such that the stimulation member abuts against the tissue within the body cavity. For treatment of rhinitis, the stimulation member may be vibrated at a frequency of about 30-70 Hz for a period of 15 seconds to 7 minutes in the nasal cavity.

SUMMARY OF THE INVENTION

It is an object of the present invention to provide improved devices for vibration stimulation. More specifically, it is an object of the present invention to provide a vibration pattern for improving vibration stimulation treatment of a mammalian subject in need thereof.

These and other objects of the present invention are achieved by means of a device for vibration stimulation having the features defined in the independent claim. Embodiments of the invention are defined by the dependent claims.

According to a first aspect of the present invention, there is provided a device for vibration stimulation in a body cavity of a mammalian subject, the device comprising: an expandable stimulation member being arrangeable in a first state, in which the stimulation member is introducible into a body cavity of the subject, and a second state, in which the stimulation member is expanded to a volume such that an outer surface of the stimulation member is adapted to abut against body tissue in the body cavity and to impart vibrations to body tissue in the body cavity of the mammalian subject; and a vibration controller adapted to control a vibration generator to bring the stimulation member to vibrate according to a vibration pattern; wherein the vibration pattern comprises a main periodic element of a first frequency and an excitation stimulus of a second frequency higher than the first frequency.

When transferred via the outer surface of the stimulation member to the body tissue of a subject, vibrations are registered by different types of receptors as described above. Each receptor type responds to vibrations within a particular frequency range. To improve vibration stimulation treatment of a subject suffering from a disease that may be treated with vibration stimulation, it would be desirable to include frequencies in the vibration pattern that may stimulate other parts of the nervous system, such as other nerve cells in the neural network. Some of these frequencies might correspond to natural frequencies of other parts of the nervous system. Further, the applicant has found that it in some instances may be advantageous to (simultaneously) target the different receptor types responsible for registering mechanical stimuli with vibrations in their individual specific sensitivity range. In view of this, the applicant has realized that more complex vibration patterns are needed to further improve vibration stimulation treatment.

The present invention is based on the concept of combining two different frequencies in a vibration pattern. The applicant has found that combining a main periodic element of a lower frequency and an excitation stimulus of a higher frequency in the vibration pattern (or vibration signal), allows stimulation at one or more sensitivity ranges of the receptors and/or matching of one or more natural frequencies of other parts of the nervous system, and thereby provides an improved vibration stimulation treatment.

Hence, the vibration pattern according to the present invention comprises both a component of a higher frequency; namely the excitation stimulus, and a component of a lower frequency; namely the main periodic element. In this context, the term "component" refers to any general part or element of the vibration pattern, and not just to a frequency component of the vibration signal. Further, such a combination may reduce any adverse effects, which may be caused by vibrations at higher frequencies.

In the present disclosure, the term "main periodic element" may refer to an element (or part) of the vibration pattern, which element provides a periodicity of the first frequency to the vibration pattern.

Further, the term "excitation stimulus" may refer to a portion of the vibration pattern providing one or more spatial shifts and/or shifts in abutting pressure of (at least a portion of) the stimulation member.

The present invention is furthermore advantageous in that it enables treatment of rather large tissues inside body cavities, which otherwise may be difficult to access. The possibility to reduce the volume of the stimulation member (i.e. bring the stimulation member to its first state) allows smoother and less cumbersome insertion of the vibration stimulation member into the body cavity. In its second state, the stimulation member has a volume such that an outer surface of the stimulation member abuts the body tissue within the body cavity. This enables vibrations to be imparted via the abutting outer surface of the stimulation member to the body tissue.

According to an embodiment of the present invention, the first frequency may be within the range of 10-100 Hz, for example within the range of 50-90 Hz, such as within the range of 60-80 Hz, or within the range of 50-70 Hz, such as around 68 Hz (e.g. 68±5 Hz). By clinical testing, e.g. vibration stimulation treatment in the nasal cavity of a human subject suffering from rhinitis, the applicant has realized that vibration frequencies within the range of 10-100 Hz are beneficial for achieving a desired therapeutic effect. Hence, by addition of a periodicity of a frequency within this range to the vibration pattern (by setting the main periodic element to such frequency), the desired therapeutic effect may be achieved. For example, tests wherein vibration stimulation was conducted in different parts of the nasal cavity of patients with diseases associated with abnormal activity in the hypothalamus (e.g., migraine, ALS, Ménière's disease and heart arrhythmia), have shown that such diseases may successfully be treated with vibration stimulation at frequencies between 40 and 100 Hz.

However, other frequency intervals are envisaged for vibration stimulation of other parts of the body and/or for other purposes.

According to embodiments of the present invention, the second frequency may be at least 1.5 times as high as the first frequency. This difference between the two frequencies allows an improved targeting of different parts of the nervous system, such as different nerve cells in the neural network, and/or natural frequency ranges of other parts of the nervous system, and/or different sensitivity ranges of the receptors. The second frequency may be 1.5-5, such as 1.9-4 times, as high as the first frequency. To high a frequency may however have an adverse impact on body tissue, as demonstrated by Kranjak et al (*JOEM* 2010, 52:584-594). In their study, vibration frequencies above 100 Hz were found to induce stress and strain, and to result in vascular changes that indicate dysfunction. Therapeutic considerations as well as other factors may thus in practice put an upper limit to the second frequency. Factors limiting the obtainable maximum frequency are e.g. the inherent inertia in the device, type of vibration generator, configuration of the stimulation member (such as material and geometry), and configuration of the transmission between the vibration generator and the stimulation member.

The applicant has found that administering vibrations to the nasal cavity according to a vibration pattern including a single frequency (or periodicity) at around 60-80 Hz increases the patient's response to the vibration treatment. For several patients, the optimum frequency was found to be around 68 Hz, e.g. 68±5 Hz. Further, it was found that the response diminished at higher frequencies (up to 100 Hz). The current knowledge of the mechanoreceptors would seem to contradict this finding since the sensitivity of the Meissner corpuscles decreases already at frequencies above 50 Hz and the sensitivity of the Pacinian corpuscles increases up to frequencies around 200-300 Hz. The applicant has thus realized that the observed advantageous frequencies (around 60-80 Hz) may be related to some other part of the nervous system.

Thus, in an embodiment of the present invention, the first frequency may be set to approximately 60-80 Hz, or approximately 50-70 Hz, (e.g. approximately 68 Hz) and the second frequency may be set to approximately 90-400 Hz, such as to approximately 110-320 Hz. This may prove beneficial in that the vibration pattern comprises both a frequency (provided by the main periodic element) shown to be effective for vibration stimulation (i.e. 60-80 Hz) and a higher frequency (provided by the excitation stimulus) for increasing activation/stimulation of, in particular, the Pacinian corpuscles.

For example, the second frequency may be set to approximately 200-300 Hz for targeting the sensitivity maximum of the Pacinian corpuscles. Alternatively, the second frequency may be set to 100-180 Hz (such as 125-145 Hz or around 136 Hz) for obtaining a harmonic of the first frequency.

It will be appreciated that each one of the first and second frequencies may be set to a constant value within any one of the above mentioned intervals or, alternatively, vary/alternate between different frequencies within any one of the above mentioned intervals.

According to an embodiment of the present invention, the vibration pattern may have a continuous waveform. Further, the time derivate of the waveform may be continuous. For example, the vibration pattern may have a sine or cosine like waveform. With the present embodiment, the abutting pressure exerted by the stimulation member on the body tissue (or the fluid pressure in the stimulation member if the stimulation member is e.g. an expandable hollow body) and/or the spatial shift of the stimulation member, may vary according to a continuous waveform. The present embodiment is advantageous in that it requires less stiffness in the vibration stimulation member (and in any transmission between the vibration generator and the stimulation member) since less abrupt shifts are to be provided. Hence, a more flexible material may be used in the stimulation member, which, in particular, is advantageous for vibration stimulation treatment of sensitive tissues, such as the bone structures in the nasal cavity.

According to an embodiment, the body cavity is selected from the nasal cavity or the intestine of the subject, wherein the stimulation member in its second state is adapted to abut against the tissue of the nasal cavity or the intestine. Thus, when the body cavity is the nasal cavity of the subject, the outer surface of the stimulation member may in its second state be adapted to abut against the tissue in the nasal cavity. When vibration stimulation is performed in the nasal cavity, the first frequency may for example be within the range of 50-70 Hz, such as 68 Hz, while the second frequency may be within the range of 90-400 Hz, such as 110-320 Hz.

When the body cavity is the intestine of the subject, the outer surface of the stimulation member may in its second state be adapted to abut against the tissue in the intestine. The applicant has found that administering vibrations to the intestine according to a vibration pattern including a single frequency (or periodicity) at around 10-20 Hz increases the patient's response to the vibration treatment. In addition, a single frequency at around 60-80 Hz, or 50-70 Hz, such as around 68 Hz, has also been found to generate a positive response in human subjects. When vibration stimulation is to be performed in the intestine, the first frequency may thus be set to a frequency within the range of 10-20 Hz. The second frequency may, when the body cavity is the intestine, be set to a frequency within the range of 50-70 Hz, such as 68 Hz. A vibration pattern for vibration stimulation with a device according to the invention in the intestine may thus comprise a first frequency within the range of 10-20 Hz and a second frequency within the range of 50-70 Hz, such as 68 Hz.

It is contemplated that various mammalian subjects may benefit from vibration stimulation with a vibration device as described herein. One example of a mammalian subject is a human subject.

Vibration stimulation may be directed to different parts of the nasal cavity of the human subject. Stimulation may for example be conducted in the posterior part of the nasal cavity for treatment of diseases associated with abnormal activity in the hypothalamus. Non-limiting examples of diseases associated with abnormal activity in the hypothalamus are migraine, Ménière's disease, hypertension, cluster headache, arrhythmia, ALS (amyotrophic lateral sclerosis), irritable bowel syndrome, sleep disorders, diabetes, obesity, multiple sclerosis, tinnitus, respiratory disorders, Alzheimer's disease, mood and anxiety disorders and epilepsy. Vibration stimulation in anterior parts of the nasal cavity may on the other hand be useful for treatment of e.g. rhinitis and asthma. In addition, vibration stimulation as described herein may also be conducted in other body cavities of the subject, both air-conducting and liquid-conducting cavities such as blood vessels and gall ducts.

Furthermore, subjects suffering from, e.g. intestinal inflammation, e.g. in the colon, ulcerous colitis, Crohn's disease, and urethritis may benefit from vibration stimulation in the intestine.

According to an embodiment of the present invention, the vibrations may be generated by means of one or more of: a fluid pressure, a motor with an eccentric weight and an electroactive material (or any other convenient vibration generator). For example, the vibration generator may comprise a frequency regulating module for providing vibrations according to the vibration pattern to a pressurized fluid in the stimulation member. The frequency regulating module may e.g. comprise a squeeze type actuator or a peristaltic pump arranged at (or in proximity to) the stimulation member for providing vibrations in pressurized fluid therein. Alternatively (or as a complement), a motor with an eccentric weight may be arranged at (or in proximity to) the stimulation member, wherein the motor may be controlled to rotate and thereby vibrate according to the vibration pattern. Further, the stimulation member may comprise electroactive material, e.g. a dielectric elastomer, controlled such that the stimulation member vibrates according to the vibration pattern.

When the vibrations are generated by means of fluid pressure, the stimulation member is e.g. an expandable hollow body. The stimulation member thus allows flow of fluid to and from the stimulation member in order to achieve expansion. In relation to the body tissue in the body cavity, the stimulation member however constitutes a fluid tight chamber to prevent leakage of fluid into the body cavity.

The vibration generator may be comprised in the device or, alternatively, externally arranged and connectable to the device (to the vibration controller and the stimulation member) in order to provide vibrations to the stimulation member.

According to an embodiment of the present invention, the device may be configured such that the stimulation member abuts, or is adapted to abut, against the body tissue at a pressure of 20-170 mbar. In particular, the outer surface of the stimulation member may be adapted to abut against the body tissue at the defined pressure. The stimulation member may in its second state e.g. abut against the tissue at a base pressure of around 20-120 mbar prior to starting the vibration treatment. During the vibration treatment, the abutting pressure of the stimulation member against the tissue may vary according to the vibration pattern, such as by a pressure of ±30-50 mbar (i.e., the amplitude of the vibration pattern may be within the range of 30-50 mbar). For example, the fluid pressure within the stimulation member may be in the range of 20-120 mbar when expanded and arranged within the body cavity (i.e. when being in the second state). It will be appreciated that the abutting pressure may be adapted to the type of body tissue to be stimulated, the type of body cavity and purpose of the treatment. For example, for stimulation in the posterior part of the nasal cavity for treatment of disorders related to abnormal hypothalamic activity, the pressure may be 70-120 mbar, such as 75-100 mbar, plus/minus the amplitude of the vibrations (such as ±30-50 mbar).

A pressure regulating module (e.g. a pressure pump) adapted to pressurize the stimulation member such that the stimulation member abuts, or is adapted to abut, against the body tissue at a desired pressure (e.g. 20-170 mbar) may furthermore be comprised in the device, or alternatively, arranged externally and connectable to the device. Such a pressure regulating module may thus regulate the degree of expansion of the stimulation member when the stimulation member e.g. is an expandable hollow body. The pressure regulating module may for example be controlled by the vibration controller. According to an embodiment of the present invention, the main periodic element may be provided by (or comprise) a main stimulus of the first frequency, wherein the main stimulus is at least partly superposed with the excitation stimulus. Hence, the main stimulus may act as a carrier wave for the excitation stimulus. According to the present embodiment, the main periodic element (and thus a periodicity having the first frequency) is implemented in the vibration pattern by the main stimulus. Thus, a higher frequency and a lower frequency may be combined in the vibration pattern by providing a vibration of the second (higher) frequency (i.e. the excitation stimulus) added to (or superposed with) a vibration of the first (lower) frequency (i.e. the main stimulus). Thus, the vibration signal (or pattern) comprises a frequency component of the first frequency and a frequency component of the second frequency. The excitation stimulus may be superposed with portions of the main stimulus, while other portions of the main stimulus may be non-superposed. Alternatively, the excitation stimulus may be continuously superposed with the main stimulus (i.e., without, or at least with less, interruptions in the excitation stimulus).

In the present disclosure, the term "main stimulus" may refer to a portion of the vibration signal providing one or more spatial shifts and/or shifts in abutting pressure of (at least a portion of) the stimulation member from a state of equilibrium. For example, the main stimulus may have continuous wave form, such as a waveform with a continuous time derivate (e.g. a sine or cosine like waveform).

According to an embodiment of the present invention, the vibration generator may comprise a first frequency regulating module and a second frequency regulating module, wherein the vibration controller may be configured to control the first frequency regulating module to provide vibrations of the first frequency (the main stimulus) and the second frequency regulating module to provide vibrations of the second frequency (the excitation stimulus). Further, the output of the first frequency regulating module and the output of the second frequency regulating module may be added for providing the vibration pattern. Consequently, a vibration pattern with the excitation stimulus added to (or superposed with) the main stimulus is provided.

For example, the two frequency regulating modules may provide vibrations to pressurized fluid supplied to the stimulation member. Alternatively, or as a complement, the frequency regulating modules may provide oscillating electrical signals, wherein the first frequency regulating module may generate a signal oscillating with the first frequency and the second frequency regulating module may generate a signal oscillating with the second frequency. By adding the outputs (i.e., the oscillating electrical signals) of the first and second frequency regulating modules, a control signal varying according to the vibration pattern is provided. Such a control signal may be used for controlling e.g. a linear motor or an electroactive material, which may be used for generating the vibrations.

According to another embodiment of the present invention, the main periodic element may be provided by (or comprise) a vibration profile repetitively initiated at the first frequency, wherein the vibration profile comprises a stimulation phase including the excitation stimulus and a rest phase (free from the excitation stimulus). Hence, the vibration pattern may comprise phases of excitation stimulus alternated with (or interrupted by) rest phases. With the present embodiment, a constant administration of vibrations of the second (higher) frequency is avoided, whereby adverse effects on the body tissue, which may be caused by high frequency vibrations, may be reduced. For example, the stimulation phase may comprise one period, or a plurality of consecutive periods, of the excitation stimulus. Further, as the rest phase may be free from stimulation, (at least almost) no vibrations are imparted to the tissue (i.e. the stimulation member is still) during the rest phase.

In the present disclosure, the term "vibration profile" may refer to a portion of a vibration signal (or pattern), which portion is repeated (or repetitively initiated) at a certain frequency (namely the first frequency). It will be appreciated that the exact configuration of the vibration profile may vary (slightly) from repetition to repetition. For example, the phase shift, waveform and/or number of periods of the excitation stimulus in the vibration profile may vary from repetition to repetition.

According to an embodiment of the present invention, the rest phase may be at least as long as the stimulation phase, for example at least 1.5, such as at least 2, times as long as the stimulation phase. The present embodiment is advantageous in that it provides more distinct interruptions between the stimulation phases and allows longer phases for the receptors to recover or rest from stimulation between the stimulation phases.

According to an embodiment of the present invention, the vibration generator may comprise a frequency regulating module and a gate, wherein the vibration controller is configured to control the frequency regulating module to provide vibrations of the second frequency (the excitation stimulus) and the gate to selectively allow transmission of the vibrations (from the second frequency regulating module) to the stimulation member such that the transmission is repetitively initiated at the first frequency. In case the vibrations are generated by fluid pressure, the frequency regulating module may be adapted to provide vibrations in pressurized fluid and the gate may be a valve controlled to open and close the communication of vibrations in the fluid between the frequency regulating module and the stimulation member.

Alternatively, the frequency regulating module may be configured to output an electric signal oscillating at the second frequency, wherein a signal processing component (which may be seen as the gate) may be configured to process the output signal from the frequency regulating module, such that the signal comprises rest phases (such a phases of zero or constant voltage). The control signal may be used to control a linear motor or an electroactive material for generating vibrations.

According to an embodiment of the present invention, the device comprises anchoring means, or an anchoring member, adapted to secure the stimulation member to the subject during the vibration stimulation. The anchoring means may comprise a headband, a facial mask, a pair of glasses, a helmet, a belt, a cuff, a vest and/or an adhesive patch. The type of anchoring means may be adapted to the particular body cavity. A headband is an example of an anchoring means suitable for securing a stimulation member for use in the nasal cavity.

According to a second aspect, a device for vibration stimulation is provided. The device comprises a stimulation member adapted to impart vibrations to body tissue (or treatment area) of a mammalian subject, and a vibration controller adapted to control a vibration generator to bring the stimulation member to vibrate according to a vibration pattern. The vibration pattern comprises a main periodic element of a first frequency and an excitation stimulus of a second frequency higher than the first frequency. It will be appreciated that the effects and advantages of the device according to the second aspect of the invention are the same as the effects and advantages of the device according to the first aspect of the invention.

According to an embodiment of the second aspect, the stimulation member may be expandable and adapted to be arranged in a first state, in which the stimulation member can be introduced into a body cavity of the subject (i.e. in which state the stimulation member may be collapsed or less expanded), and a second state, in which the stimulation member is expanded to a volume such that the stimulation member abuts against body tissue in the body cavity.

According to an embodiment of the second aspect, the stimulation member may be adapted to be applied to a body surface (rather than a body cavity), such as on the abdomen.

According to a third aspect of the invention, a method of treatment of a human subject is provided. The method comprises the step of imparting vibrations to a body tissue of the human subject according to a vibration pattern, wherein the vibration pattern comprises a main periodic element of a first frequency and an excitation stimulus of a second frequency higher than the first frequency. It will be appreciated that the effects and advantages of the method according to the third aspect of the invention are the same as the effects and advantages of the device aspects of the invention.

According to a fourth aspect, there is provided a method of treatment of a human subject, comprising the steps of: introducing an expandable stimulation member into a body cavity of the human subject, said expandable stimulation member being adapted to impart vibrations to body tissue of the human subject; expanding the stimulation member to a volume such that the stimulation member abuts against body tissue within the body cavity; bringing the stimulation member to vibrate such that vibrations are imparted to the body tissue in the body cavity of the human subject according to a vibration pattern, wherein the vibration pattern comprises a main periodic element of a first frequency and an excitation stimulus of a second frequency higher than the first frequency. It will be appreciated that the effects and advantages of the method according to the fourth aspect of the invention are essentially the same as the effects and advantages of the previous device and method aspects of the invention. It will further be appreciated that the following embodiments are applicable to all aspects of the invention unless stated otherwise.

In an embodiment of the method aspects, the vibrations may be imparted using a device according to any one of the embodiments described in connection to the first aspect of the present invention. When introducing the stimulation member, it may be arranged in a first (collapsed or less expanded) state.

In an embodiment of the method aspects, the first frequency may be within the range of 10-100 Hz, such as 50-90 Hz, such as 60-80 Hz and such as around 68 Hz.

In an embodiment of the method aspects, the second frequency may be at least 1.5 times as high as the first frequency.

In an embodiment of the method aspects, the second frequency may be 1.5-5, such as 1.9-4 times as high as the first frequency.

In an embodiment, the vibration pattern may have a continuous waveform.

In an embodiment of the method aspects, the main periodic element may be provided by a main stimulus of the first frequency, wherein the main stimulus may be at least partly superposed with the excitation stimulus.

In an embodiment of the method aspect, the main periodic element may be provided by a vibration profile repetitively initiated at the first frequency, the vibration profile comprising a stimulation phase including the excitation stimulus and a rest phase.

In an embodiment of the method aspects, the rest phase may be at least as long as the stimulation phase, such as at least 1.5 times as long as the stimulation phase, such as at least 2 times as long as the stimulation phase.

In an embodiment of the method aspects, the body cavity may be selected from the nasal cavity and the intestine of the subject.

When treatment is performed in the nasal cavity, the step of expanding may in an embodiment further comprise expanding the stimulation member to a volume such that the stimulation member abuts against body tissue in the nasal cavity at a pressure in a range of from 50 to 120 mbar.

Treatment according to method aspects described herein may be performed in the nasal cavity of human subjects suffering from a disease selected from the group consisting of rhinitis, asthma, migraine, Ménière's disease, hypertension, cluster headache, arrhythmia, ALS, irritable bowel syndrome, sleep disorders, respiratory disorders, diabetes, obesity, multiple sclerosis, tinnitus, Alzheimer's disease, mood and anxiety disorders, and epilepsy.

In particular, when the human subject suffers from a disease associated with abnormal activity in the hypothalamus, the stimulation member may advantageously abut against body tissue in the nasal cavity at a pressure in a range of from 70 to 120 mbar. A disease associated with abnormal activity in the hypothalamus is for example selected from the group consisting of migraine, Ménière's disease, hypertension, cluster headache, arrhythmia, ALS, irritable bowel syndrome, sleep disorders, respiratory disorders, diabetes, obesity, multiple sclerosis, tinnitus, Alzheimer's disease, mood and anxiety disorders, and epilepsy.

When treatment is conducted in the nasal cavity, the first frequency is in an embodiment of the method aspects within a range from of 50 to 70 Hz and the second frequency is within a range of from 110 to 320 Hz.

When treatment is conducted in the intestine, the step of expanding may in one embodiment comprise expanding the stimulation member to a volume such that the stimulation member abuts against body tissue in the intestine at a pressure in a range of from 20 to 50 mbar.

Treatment according to method aspects described herein may be performed in the intestine of a human subject suffering from a disease selected from the group consisting of irritable bowel syndrome, intestinal inflammation, ulcerous colitis, and Crohn's disease.

When treatment is performed in the intestine, the first frequency is in an embodiment within a range of from 10 to 20 Hz and the second frequency is within a range of from 50 to 70 Hz.

According to a fifth aspect, there is provided a method of treatment of a human subject, comprising the steps of: applying a stimulation member to a body tissue of a human subject, said stimulation member being adapted to impart vibrations to body tissue of the human subject; selecting a first frequency by imparting vibrations to said body tissue at a variable frequency; gradually adjusting the variable frequency up to a maximum frequency; monitoring a bodily response to the treatment, the bodily response being indicative of a physiological (or health) condition of the subject; setting the first frequency to a frequency within ±20 Hz, such as ±10 Hz, of the variable frequency at which the bodily response is maximized (or at least increased), and imparting vibrations to the body tissue of the human subject according to a vibration pattern, wherein the vibration pattern comprises a main periodic element of the first frequency and an excitation stimulus of a second frequency higher than the first frequency.

The maximum frequency may in this context be understood as an upper frequency limit above which a vibration pattern cannot be imparted to the human subject. The frequency selection is thus bounded by this maximum obtainable frequency. The maximum frequency may be within a range of 200-500 Hz.

Hence, the first frequency is set to a value corresponding to the frequency of the main periodic element at which the bodily response is maximized ±20 Hz. So if the frequency of the main periodic element at which the bodily response is maximized is $F_{1MAX}$, the first frequency is set to a value within the range of $F_{1MAX}-20$ Hz to $F_{1MAX}+20$ Hz. For example, the first frequency may be set to $F_{1MAX}$. If the bodily response is maximized at more than one frequency a lower frequency is preferably selected to avoid subjecting tissue to potentially damaging high frequency vibrations. The present embodiment is advantageous in that the vibration pattern is adjusted to provide an increased bodily response to the treatment. This means that the frequency (±20 Hz) having the largest influence on (or change in) the bodily response monitored is selected for vibration stimulation, since the largest influence on the bodily response is correlated to a desired effect on the subject's health condition. Evidently, a desired effect on a subject's health condition may be an upregulation as well as a downregulation.

Alternatively, a desired effect on a subject's health condition may be a return from an upregulated or downregulated state to a normal state. The first frequency is thus set to a frequency at which the bodily response is stabilized.

In an embodiment of the fifth aspect, the variable frequency may be gradually adjusted between a first lower limit (e.g. being within the range of 10-60 Hz) and a first upper limit, the first upper limit being within the range of 80-120 Hz, such as around 100 Hz. The applicant has found that vibration treatment at a first frequency between said first lower and upper limit achieves a beneficial effect on the health condition of human subjects.

In an embodiment of the fifth aspect, the method may further comprise selecting the second frequency by gradually adjusting the frequency of the excitation stimulus from the first frequency up to the maximum frequency; monitoring a bodily response to the treatment, the bodily response being indicative of a physiological condition of the subject, and setting the second frequency to a frequency within ±20 Hz, such as ±10 Hz, of the frequency of the excitation stimulus at which the bodily response is maximized.

Hence, the second frequency is set to a value corresponding to the frequency of the excitation stimulus at which the bodily response is maximized ±20 Hz. So if the frequency of the excitation stimulus at which the bodily response is maximized is $F_{2MAX}$, the second frequency is set to a value within the range of $F_{2MAX}$−20 Hz to $F_{2MAX}$+20 Hz. For example, the second frequency may be set to $F_{2MAX}$. The present embodiment is advantageous in that the vibration pattern is adjusted to provide an increased bodily response to the treatment. The frequency (±20 Hz) giving the largest change (whether positive or negative) in bodily response is selected as the second frequency. This is similar to the selection criteria described above in connection with selection of the first frequency.

In an embodiment of the fifth aspect, the method may further comprise selecting the first frequency and the second frequency in such a way so as to maximize the therapeutic effect in the human subject while avoiding the use of unnecessary high frequencies. This is accomplished by gradually increasing the variable frequency (the frequency of the main periodic element) starting from a lower limit (e.g. 10 Hz) while not applying any excitation stimulus, monitoring a bodily response to the treatment, the bodily response being indicative of a physiological (or health) condition of the subject, and setting the first frequency to a frequency within ±20 Hz, such as ±10 Hz, of the frequency of the main periodic element at which the bodily response is maximized (or at least increased). The second frequency is then selected by gradually increasing the second frequency starting from the value just selected for the first frequency, monitoring a bodily response to the treatment, the bodily response being indicative of a physiological (or health) condition of the subject, and setting the second frequency to a frequency within ±20 Hz, such as ±10 Hz, of the frequency of the main periodic element at which the bodily response is maximized (or at least increased). The excitation stimulus may during this procedure comprise one full oscillation period, i.e. the effect of increasing the second frequency will be to increase a rest phase between single excitation pulses.

In an embodiment of the fifth aspect, the method may further comprise selecting the first and second frequency by applying a number (such as between four and nine) of different combinations of frequencies where the second frequency is always higher than the first frequency and the first frequency and the second frequency both are bounded by an upper limit, and/or maximum frequency. This upper limit or maximum frequency may either be imposed from clinical reasons or may be a practical limitation of any system used for administering the vibration treatment. A bodily response to the stimulation is recorded for each combination of frequencies applied and the combination giving the most desired response is selected. In case several combinations give the same response the one corresponding to the lowest second frequency is selected. This selection procedure may either be performed once per indication or for every subject to be treated.

In an embodiment of the fifth aspect, the frequency of the excitation stimulus may be gradually adjusted between a second lower limit (e.g. being within the range of 15-150 Hz) and second upper limit, the second upper limit being within the range of 200-450 Hz, such as around 350 Hz.

In an embodiment of the fifth aspect, the stimulation member may be expandable and the step of applying further comprises: introducing the stimulation member into a body cavity of the subject; and expanding the stimulation member to a volume such that the stimulation member abuts against body tissue in the body cavity. The body cavity is for example selected from the nasal cavity and the intestine of the subject.

The activity in a biological target, such as the hypothalamus, can be measured by different qualitative and/or quantitative methods. In particular, changes in physiological parameters such as for example blood flow, oxygen consumption and metabolic activity are correlated to changes in the level of activity of the biological target, such as the hypothalamus. Depending on the present health condition of a human subject treated with a device according to the first aspect, stimulation may alter the level of activity in the biological target, such as the hypothalamus, somewhat differently. If for example a human subject suffering from a medical condition associated with an abnormal activity in the hypothalamus is treated with a method according to this aspect, vibration stimulation may result in normalized hypothalamic activity. Normalization in this context may refer to a condition where the activity of a biological target is comparable to the activity in surrounding tissue. Thus, a normalized hypothalamic activity may refer to an activity which is comparable to the activity in surrounding brain tissue. The different measures of the activity of the biological target, such as the hypothalamus, can be monitored directly or indirectly.

Furthermore, the same reasoning is valid for other biological targets, such as the sphenopalatine ganglion. The activity in the sphenopalatine ganglion can be measured by different direct or indirect qualitative and/or quantitative methods.

The method of treatment may beneficially be administered to a human subject suffering from a disease, or medical condition, selected from the group consisting of rhinitis, migraine, Ménière's disease, hypertension, cluster headache, arrhythmia, ALS, irritable bowel syndrome, sleep disorders, diabetes, obesity, multiple sclerosis, tinnitus, respiratory disorders, e.g. tracheobronchomalacia, Alzheimer's disease, mood and anxiety disorders, epilepsy, intestinal inflammation, e.g. in the colon, ulcerous colitis, Crohn's disease, and urethritis. Treatment in either the nasal cavity or the intestine may in particular be advantageous when the subject suffers from one of the above mentioned diseases.

In an embodiment of the method aspects, the bodily response may be monitored by measuring one or more of: nasal secretion, sneeze frequency, pain sensation, pupil size, oxygen consumption in selected parts of the brain (which may be measured by functional magnetic resonance imaging, fMRI), metabolic activity in selected parts of the human body (which may be measured by means of positron emission tomography, PET), brain activity (which may be measured by means of magnetoencephalography, MEG, or electroencephalography, EEG), heart activity (which may be measured by means of electrocardiography, ECG), muscle activity (which may be measured by means of electromyography, EMG), blood pressure, a (fluid) volume within an organ (which may be measured by means of a photoplethysmograph), tissue conductivity, body temperature, a pressure between the body tissue and a stimulation member imparting the vibrations. Pain sensation can be estimated by the human subject himself/herself by reference to a visual analogue scale (VAS). In case the bodily response is the pressure between the body tissue and the stimulation member, the stimulation member may comprise a pressure sensor for measuring the pressure exerted on the tissue as well as changes in the pressure due to body tissue response.

In an embodiment of the method aspects, the vibrations may be provided by one or more of: fluid pressure, a motor with an eccentric weight and an electroactive material. For example, the vibrations may be imparted by means of a vibration generator as described in connection to the first aspect of the present invention.

In an embodiment of the method aspects, the vibrations may be imparted to the body tissue with a pressure of 20-170 mbar. For example, the stimulation member, as described in connection to the first aspect of the present invention (or any other means for imparting the vibrations), may abut against the tissue at a pressure of 20-170 mbar. Further, an average pressure within the stimulation member, when imparting vibrations, may be within the range of 20-120 mbar.

In an embodiment of the method aspects, the first frequency and the second frequency target different receptor types responsible for registering mechanical stimuli with vibrations. The first and the second frequency may advantageously be selected from frequency intervals as defined herein in order to target specific receptor types. The first frequency may be selected within the range of 10-100 Hz, whereas the second frequency may independently be a harmonic of the first frequency or selected such as to target the sensitivity maximum of the Pacinian corpuscles as described hereinbefore.

It will be appreciated that the effects and advantages with the embodiments described in connection with the method aspects of the present invention are the same as the effects and advantages with the corresponding embodiments described in connection with the device aspects of the present invention.

Further objectives of, features of, and advantages with, the present invention will become apparent when studying the following detailed disclosure, the drawings and the appended claims. Those skilled in the art realize that different features of the present invention can be combined to create embodiments other than those described in the following. In particular, it will be appreciated that the various embodiments described for the device are all combinable with the method as defined in accordance with the third aspect of the present invention.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, in which.

DETAILED DESCRIPTION OF THE PREFERRED EMBODIMENTS

Figure 1A:
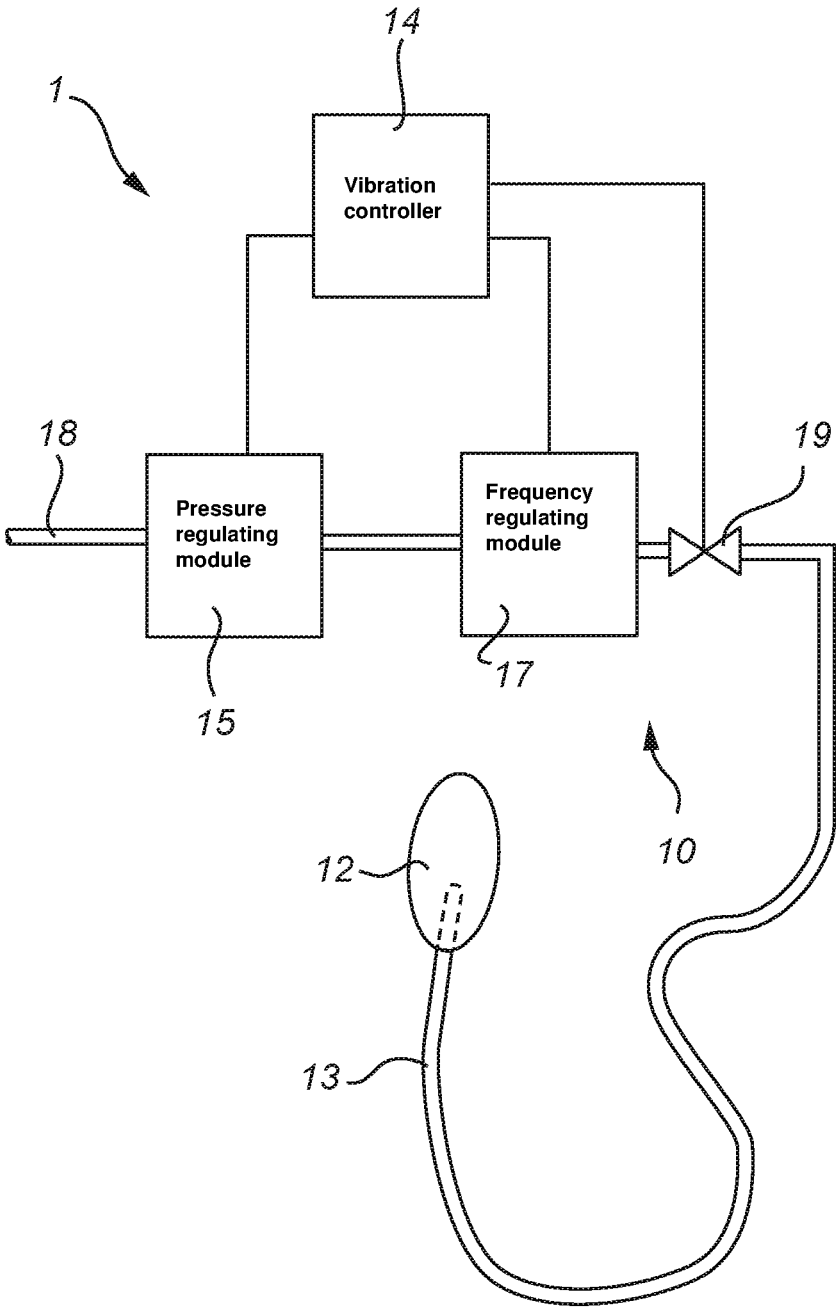
FIG. 1*a* shows a device for vibration stimulation according an embodiment of the present invention.

The present invention will now be described with reference to the accompanying drawings, wherein the same or similar elements are identified with the same reference numeral.

All the figures are schematic, not necessarily to scale, and generally only show parts which are necessary in order to elucidate the invention, wherein other parts may be omitted or merely suggested.

Figure 1B:
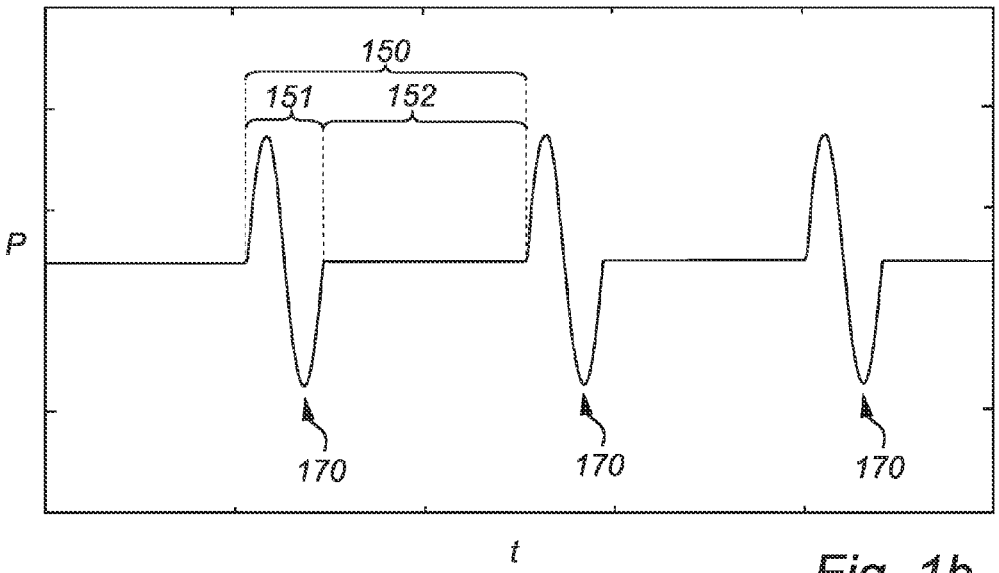
FIG. 1*b* shows an example of a vibration pattern obtainable by the device shown in FIG. 1*a;*
Figure 1C:
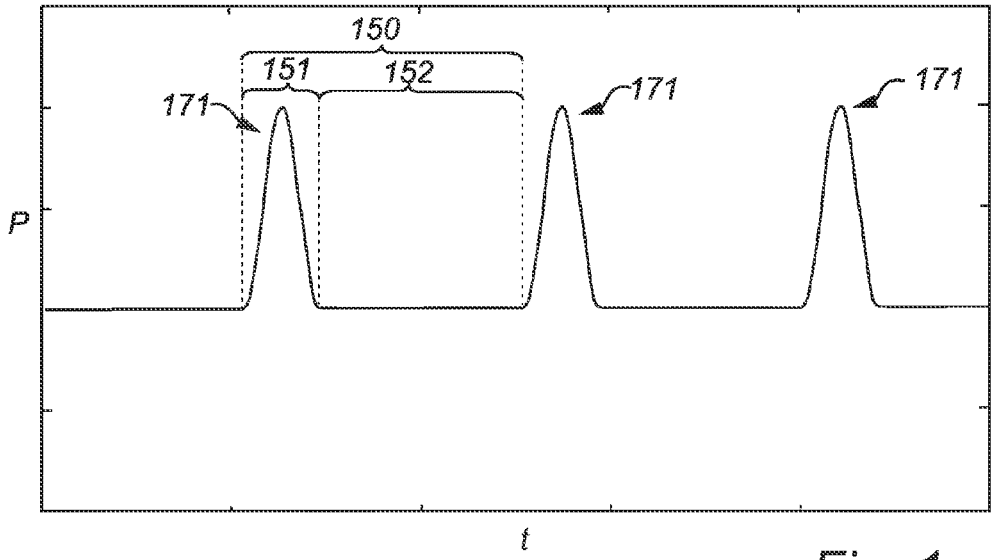
FIG. 1*c* shows another example of a vibration pattern obtainable by the device shown in FIG. 1*a;*

With reference to FIGS. 1*a*-1*c*, a device for vibration stimulation according to an embodiment of the present invention will be described. FIG. 1*a* is a schematic view of the device, and FIGS. 1*b* and 1*c* show two examples of vibration patterns obtainable by the device.

FIG. 1*a* shows a vibration stimulation device 1 comprising a stimulation member 12 adapted to impart vibrations to a body tissue of a subject, and a vibration generator 10. In the present embodiment, the vibrations are generated by fluid pressure, wherein the stimulation member 12 may comprise an expandable balloon (or catheter or bladder) in fluid communication with the vibration generator 10 via a tubing 13. Hence, the stimulation member 12 may comprise a chamber for containing fluid supplied by the tubing 13.

The stimulation member 12 may be arranged in a collapsed (or less expanded) state for insertion in a body cavity, such as the nasal cavity or intestine, of a human subject. When inserted, the stimulation member 12 may be expanded to a volume such that an outer surface of the stimulation member abuts against the inside of the body cavity (which will be explained in more detail further on with reference to FIG. 3). The supply of fluid to the stimulation member 12 via the tubing 13 influences the volume and degree of expansion of the stimulation member 12.

The stimulation member 12 may be made of a material not chemically or biologically affecting body tissues with which it comes into contact and the outer surface may be adapted to reduce friction between the stimulation member 12 and the surrounding tissue. The stimulation member 12 may e.g. be made of a material providing a smooth outer surface or be coated with a lubricant, such as e.g. a paraffin solution. Further, the stimulation member 12 may be elastic, whereby its surface area may depend on the fluid pressure in the stimulation member. Alternatively, the stimulation member 12 may be inelastic. Non-limiting examples of materials, which the stimulation member 12 may be made of, are plastic materials or rubber materials. In some instances, the stimulation member 12 may be made of latex.

Further details and embodiments of the stimulation member are described in the published international patent application WO 2008/138997, by the same applicant, which is hereby incorporated by reference.

The device 1 may include a pressure regulating module 15 (e.g. a pressure pump) adapted to pressurize fluid (such as air) entered via an inlet 18. The pressure regulating module 15 is in fluid communication with the vibration generator 10, which comprises a frequency regulating module 17 (e.g. an oscillation pump) adapted to provide vibrations to the pressurized fluid. The frequency regulating module 17 is adapted to provide vibrations of a selected frequency/frequencies and may also be adapted to regulate the amplitude of the vibrations. The pressurized fluid and the vibrations are transmitted (or supplied) via the tubing 13 to the stimulation member 12. The vibration generator 10 further comprises a gate 19, such as a valve (e.g. an electromechanical valve), arranged to selectively allow the transmission of vibrations from the frequency regulating module 17 to the stimulation member 12, e.g. by opening and closing the fluid communication there between.

It will be appreciated that all of, or two of, the pressure regulating module 15, the frequency regulating module 17 and the gate 19 may be comprised in the same module, even though they are schematically depicted as separate units in FIG. 1*a*. Further, it will be appreciated that the pressure regulating module 15 either may be an external module connected to the vibration generator 10 of the device 1, or comprised in the device 1.

In the present embodiment, the frequency regulating module 17 and the gate 19 are connected directly on a main fluid communication line connecting the pressure regulating module 15 to the tubing 13. Alternatively, the frequency regulating module and the gate may be arranged on a separate fluid communication line connected to the main fluid communication line via a T-junction.

Optionally, the device 1 may comprise a pressure sensor (not shown), such as a manometer adapted to measure the fluid pressure in the device 1, and/or a safety valve (not shown) arranged to release fluid from the device 1 if the pressure exceeds a predetermined threshold.

The device 1 further comprises a vibration controller 14 configured to control the vibration generator 10 to bring the stimulation member 12 to vibrate according to a vibration pattern. The vibration controller 14 may be configured to control the frequency regulating module 17 and thereby the frequency (and optionally also the amplitude) of the vibrations, and the opening and closing of the gate 19 (or valve) and thereby any interruptions in the vibrations. Optionally, the vibration controller 14 may further be configured to control the pressure regulating module 15 and thereby the fluid pressure in the device 1.

Two examples of vibration patterns, according to which the stimulation member 12 of the device 1 according to the present embodiment may be brought to vibrate, will be described with reference to FIGS. 1*b* and 1*c*.

Each one of FIGS. 1*b* and 1*c* schematically illustrate how the abutting pressure p of the stimulation member 12 against the body tissue varies over time t. The pattern according to which the pressure varies is the vibration pattern (or vibration signal) of the device 1. The p-axis in FIGS. 1*b* and 1*c* may alternatively be seen as the spatial shift of the stimulation member 12 causing the vibrations or the fluid pressure inside the stimulation member 12.

The vibration pattern shown in FIG. 1*b* comprises a vibration profile 150 including a stimulation phase 151 and a rest phase 152, wherein the vibration profile 150 is repetitively initiated at a first frequency. The stimulation phase 151 comprises an excitation stimulus 170, which represents a shift (such as one or more increases and/or decreases) in the abutting pressure p. The excitation stimulus 170 has a second frequency being higher than the first frequency and may have a substantially continuous waveform, such as in the present example with a sine waveform. Continuous waveforms in the vibration pattern allows constructing the stimulation member 12 (and other parts of the device 1) in more flexible materials.

In the present example, the stimulation phase 151 comprises one period of the excitation stimulus 170, but it may alternatively comprise more than one period, such as 1.5, 2, 2.5, 3, or more periods. The number of periods may be selected based on the relation between the first and second frequencies and the desired lengths of the stimulation and rest phases 151, 152. In the present example, the second frequency is approximately 3.7 times as high as the first frequency and the rest phase 152 is approximately 2.7 times as long as the stimulation phase 151. In the present example, the first frequency may be set to approximately 68 Hz (or around 60-80 Hz) and the second frequency to approximately 250 Hz (or around 110-320 Hz) for targeting different parts of the nervous system being sensitive to vibrations. However, other first and second frequencies are also envisaged, as they may be selected based on the purpose of the vibration stimulation treatment.

The rest phase 152 represents an interruption in the vibrations provided during the stimulation phase 151. Further, the abutting pressure p may be constant during the rest phase 152, whereby no vibrations are imparted to the body tissue during that phase. The alternation between the stimulation phase 151 and the rest phase 152 provides a main periodic element of the first frequency to the vibration pattern. For example, the main periodic element may be seen as the periodicity provided by repetitive alternation between the stimulation phase 151 and the rest phase 152.

The vibration pattern shown in FIG. 1*c* is similar to the vibration pattern described with reference to FIG. 1*b* except that the excitation stimulus 171 (in the stimulation phase 151 of the vibration profile 150) is formed as an offset cosine wave. In this embodiment, the vibration pattern and its time derivative are continuous. This is achieved by providing an excitation stimulus 171 with the time derivative equal to zero at both end points. In the present example, the stimulation phase 151 comprises one period of the excitation stimulus 171, but it may alternatively comprise more than one period.

An example of how the above described vibration patterns may be provided by the device 1 according to the present embodiment will be described in the following. The vibration controller 14 controls the frequency regulating module 17 to provide vibrations of the second frequency in the pressurized fluid from the pressure regulating module 15. Further, the vibration controller 14 controls the gate 19 to repetitively open and close, such that transmission of the vibrations to the stimulating member 12 is allowed during the stimulation phases 151 and blocked during the rest phases 152. The timing of opening and closing the valve may be accurately controlled to achieve a continuity in the vibration pattern. Alternatively, the vibration controller 14 may be configured to control the frequency generator 17 to provide pulses of vibrations of the second frequency, such that the pulses are repetitively initiated at the first frequency, whereby a valve 19 may not be required.

Figure 2A:
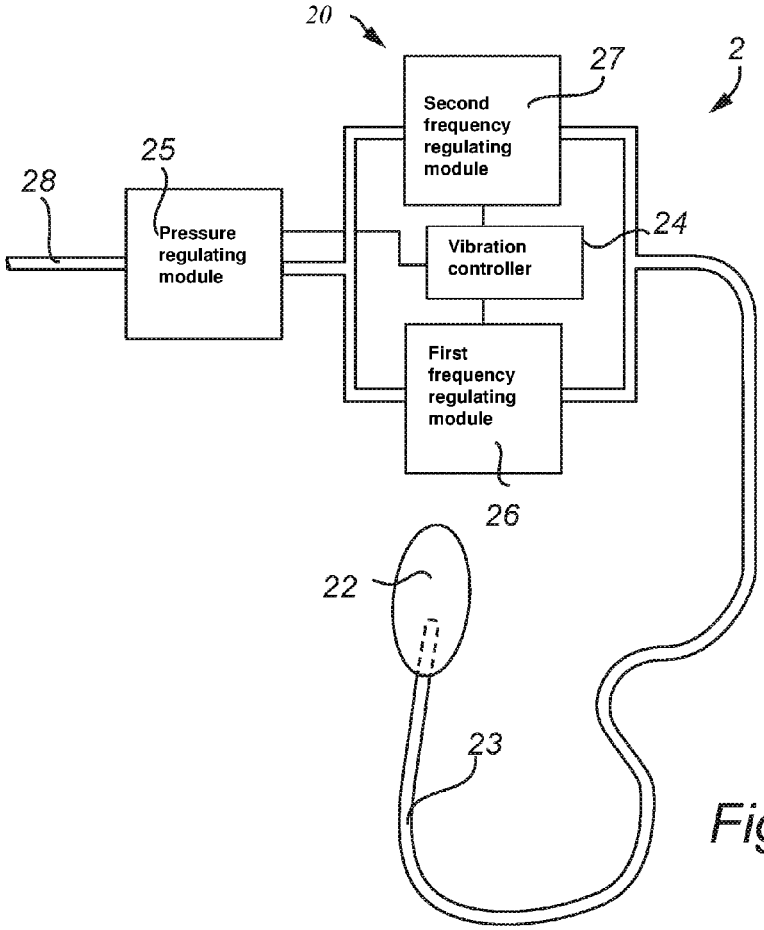
FIG. 2*a* shows a device for vibration stimulation according another embodiment of the present invention.

A device for vibration stimulation according to another embodiment of the present invention will be described with reference to FIG. 2*a*. The basic structure and basic operation principle of the device 2 and each one of its constituents shown in FIG. 2*a* may be the same as the basic structure and basic operation principle of the device 1 and its constituents shown in FIG. 1*a*, except for the configuration of the vibration generator 20 and the vibration controller 24.

In the present embodiment, the vibration generator 20 comprises a first frequency regulating module 26 and a second frequency regulating module 27. Each one of the first and second frequency regulating modules 26, 27 are in fluid communication with the pressure regulating module 25, which is arranged to pressurize fluid taken in at the inlet 28. The vibration controller 24 is configured to control the first frequency regulating module 26 to provide the pressurized fluid with vibrations of the first frequency and the second frequency regulating module 27 to provide the pressurized fluid with vibrations of the second frequency (which is higher than the first frequency). The outputs (i.e., the vibrations in the pressurized fluid) from the first and second frequency regulating modules 26, 27 are added, such that pressurized fluid with vibrations of the first frequency superposed with vibrations of the second frequency is provided and may be transmitted via the tubing 23 to the stimulation member 22. Optionally, the device 1 may comprise one or more gates, such as valves, (not shown) for controlling the transmission of vibrations from the first and/or second generating modules 26, 27.

An example of a vibration pattern, according to which the stimulation member 22 of the device 2 according to the present embodiment may be brought to vibrate, will be described with reference to FIG. 2*b*.

Figure 2B:
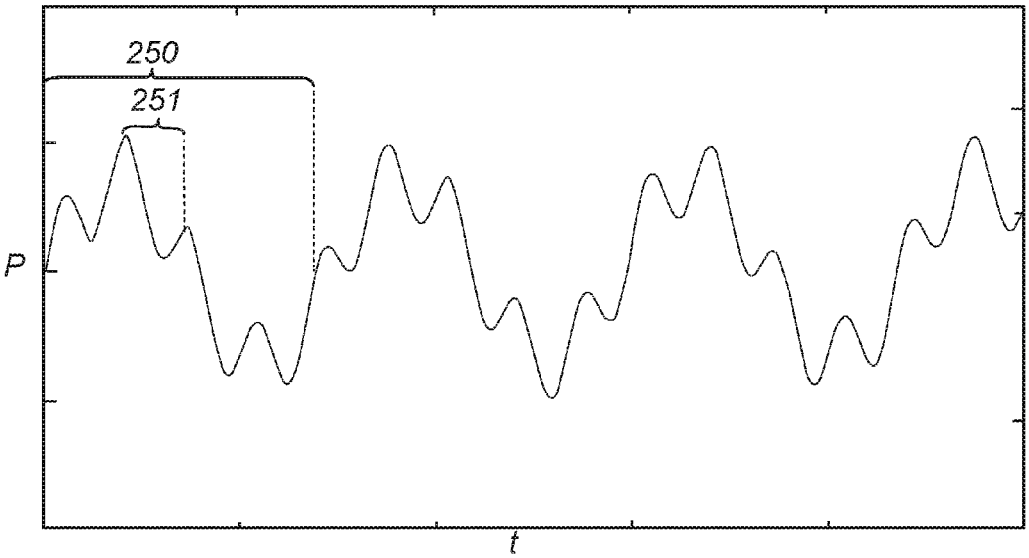
FIG. 2*b* shows an example of a vibration pattern obtainable by the device shown in FIG. 2*a;*

FIG. 2*b* schematically illustrates how the abutting pressure p of the stimulation member 22 against the body tissue varies over time t. The pattern according to which the pressure varies is the vibration pattern (or vibration signal) of the device 2. The p-axis in FIG. 2*b* may alternatively be seen as the spatial shift of the stimulation member 22 causing the vibrations or the fluid pressure inside the stimulation member 22.

The vibration pattern comprises a main stimulus of the first frequency, the period of which is denoted with reference number 250 in FIG. 2*b*. The main stimulus represents a shift (such as one or more increases and/or decreases) in the abutting pressure p occurring at the first frequency and is provided by the first frequency regulating module 26. Superposed with the main stimulus is an excitation stimulus of the second frequency, the period of which is denoted with reference number 251 in FIG. 2*b*. The excitation stimulus is provided by the second frequency regulating module 27. Hence, the main stimulus acts as a carrier wave for the excitation stimulus, as the vibration outputs from the first and second frequency regulating modules 26, 27 are added.

The second frequency is higher than the first frequency, and in this non-limiting example, the second frequency is approximately 4.4 times as high as the first frequency. Hence, the vibration pattern comprises a main periodic element of the first frequency provided by the main stimulus (or the periodicity of the main stimulus), and an element (or component) of a higher frequency provided by the excitation stimulus. In the present example, the first frequency may be set to approximately 68 Hz (or around 60-80 Hz) and the second frequency to approximately 300 Hz (or around 110-320 Hz) for targeting different sensitivity ranges of the receptors sensitive to vibrations in the body. However, other first and second frequencies are also envisaged, as they may be selected based on the purpose of the vibration stimulation treatment.

In the present example, the main stimulus and the excitation stimulus are continuously superposed (without interruptions). However, the excitation stimulus may alternatively be partly superposed with the main stimulus, such that phases with the two superposed stimuli are alternated with phases with the non-superposed main stimulus.

Further, the amplitude of the excitation stimulus may be lower than the amplitude of the main stimulus, whereby the main stimulus may dominate the vibration pattern, or alternatively, the amplitude of the excitation stimulus may be higher than the amplitude of the main stimulus, whereby the excitation stimulus may dominate the vibration pattern. Further, the amplitude of the excitation stimulus may vary over time, such as within each phase of the main stimulus.

The Pacinian corpuscles are more sensitive to velocity and acceleration as the vibration frequency increases. Hence, if the total amplitude of the vibration pattern is limited, it may be advantageous to have a lower amplitude for the excitation stimulus than for the main stimulus, since the receptors are more sensitive at higher frequencies (such as between 200 Hz and 300 Hz). However, this may provide that the achieved velocities and accelerations (of the vibrations) are smaller than what would be obtainable with the same amplitude limitation in the embodiment wherein the main periodic element is provided by the vibration profile with a stimulation phase and a rest phase. Thus, the embodiment wherein the main periodic element is provided by the vibration profile with a stimulation phase and a rest phase may be advantageous for obtaining higher velocities and accelerations of the vibrations.

It will be appreciated that shapes of the vibration patterns illustrated in the Figures are schematic and show the principles of the embodiments of the present invention.

Figure 3:
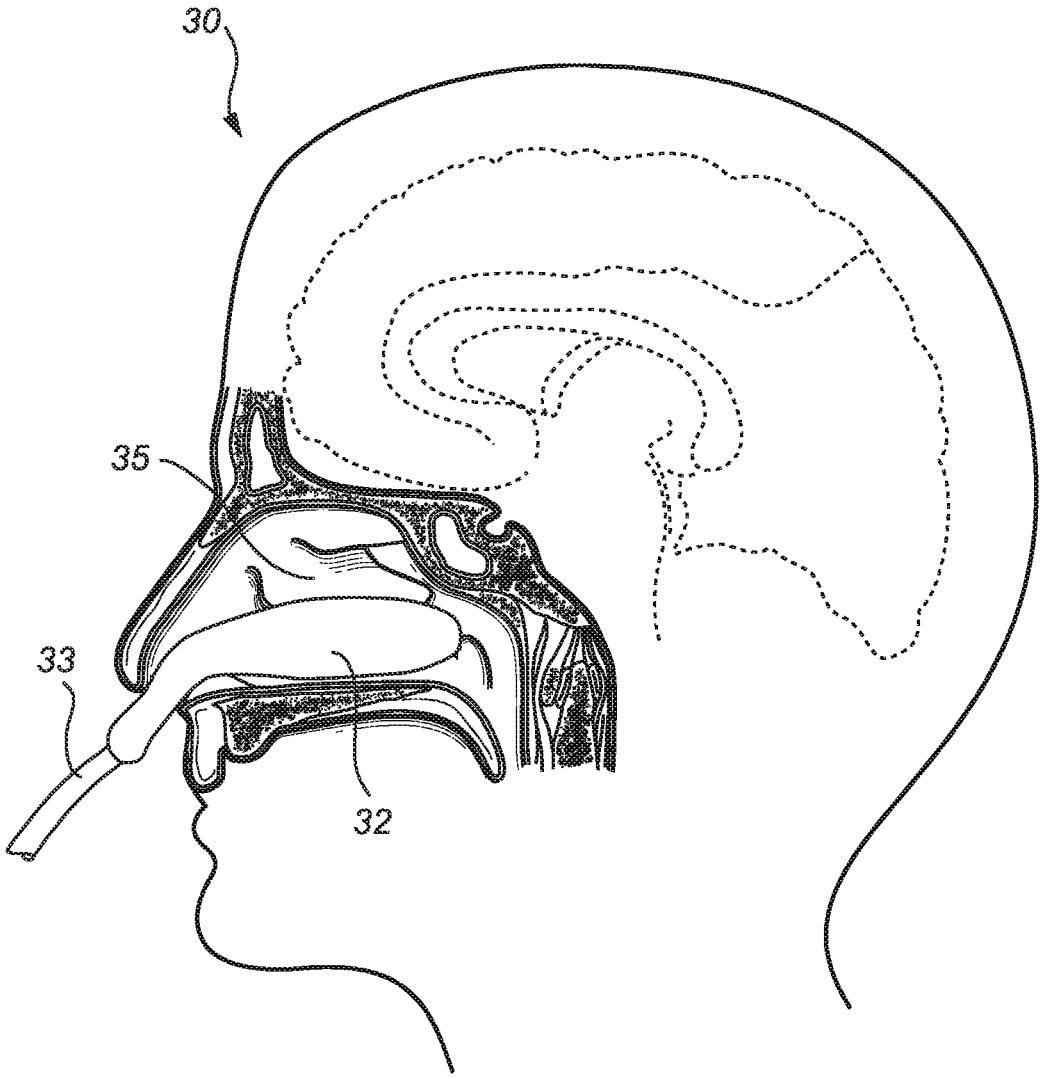
FIG. 3 shows a stimulation member of the device positioned within the nasal cavity of a human subject.

With reference to FIG. 3, an embodiment of a method of treatment of a human subject by means of device according to an embodiment of the present invention will be described. FIG. 3 shows a stimulation member 32 inside the nasal cavity 35. The stimulation member 32 is connected to a tubing 33. For instance, the device may be constructed as any one of the devices described with reference to FIGS. 1*a* and 2*a*.

The purpose of the method according to the present embodiment may e.g. be to treat a disease associated with the activity of hypothalamus (e.g., migraine, ALS, Ménière's disease and heart arrhythmia) or rhinitis.

At a first stage, the stimulating member 32 is arranged in a collapsed (first) state, in which its size is sufficiently small to be introduced into the nasal cavity 35 of the human subject 30. The stimulation member 32 may also be provided with a lubricant, e.g. paraffin, to facilitate the introduction through the nostril. The stimulation member 32 is inserted into the nasal cavity 35 and if any disease associated with the activity of hypothalamus is to be treated, the stimulation member may be adapted for stimulation in the posterior part of the nasal cavity 35 (as shown in FIG. 3), and if e.g. rhinitis is to be treated, the stimulation member 32 may be adapted for stimulation in the anterior part of the nasal cavity (not shown). The stimulation member may be secured to the human subject 30 via anchoring means for reducing the risk of displacement of the stimulation member 32 during the treatment. Subsequently, the stimulation member 32 is pressurized such that it expands until it abuts the tissue of the selected parts of the nasal cavity 35 with a desired pressure (which may be monitored by the manometer), such as 20-120 mbar. Subsequently, the vibration controller controls the vibration generator to bring the stimulation member 32 to vibrate according to a vibration pattern comprising a main periodic element of a first frequency and an excitation stimulus of a second frequency higher than the first frequency (such as any of the previously described vibration patterns). The vibration treatment may e.g. last 1 minute to 30 minutes.

Figure 4:
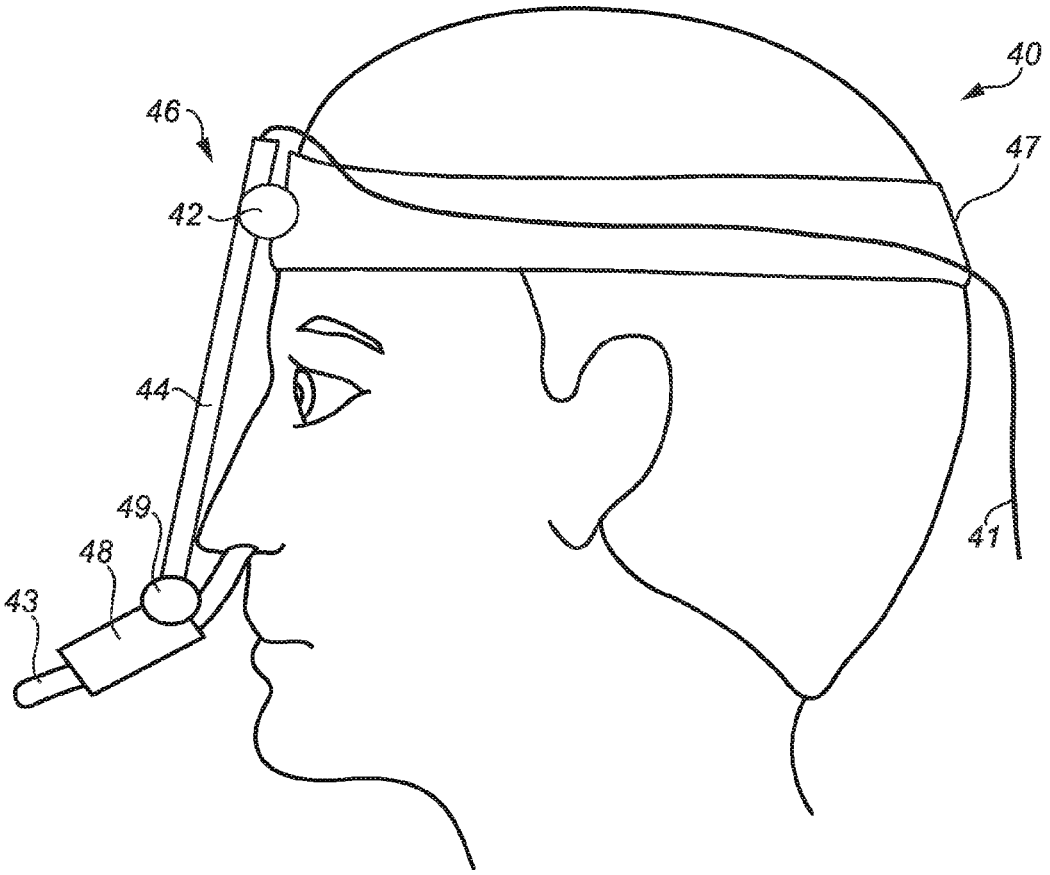
FIG. 4 shows a stimulation member and an anchoring member of a device according to another embodiment of the present invention.

With reference to FIG. 4, an anchoring means and an alternative vibration generator of a device according to an embodiment of the present invention will be described. It will be appreciated that the following example may be combined with any one of the preceding examples described above.

FIG. 4 shows a stimulation member of the device inserted in the nasal cavity of a human subject 40. The device comprises anchoring means 46, which may comprise a headband 47, as shown in FIG. 4. Alternatively, the anchoring means may comprise a facial mask, a pair of glasses, a helmet, a belt, a cuff, a vest and/or an adhesive patch (not shown).

Headbands, facial masks, glasses and helmets are in particular suitable for anchoring the stimulation member in the nasal cavity and at parts of the head and neck. Belts may be suitable for anchoring the stimulation member at the torso, and cuffs may be suitable for anchoring the stimulation member at the extremities, i.e. an arm or a leg.

Further, the device comprises a pipe 44 (or rod) mounted to the headband 47 via an adjustable joint 42 and vibration generator comprising a squeeze actuator 48 mounted to the pipe 44 via a connector 49 (such as a mechanical or electrical connector). The squeeze actuator 48 may comprise a sleeve circumferentially mounted around a tubing 43 connected to the stimulation member and may be electrically connected to a vibration controller via wiring 41. The wiring 41 may be provided inside the pipe 44 to prevent the wiring from interfering with the treatment. In the present embodiment, a pressure regulating module (not shown) provides pressurized fluid via the tubing 43 to the stimulation member. The vibration controller is configured to control the squeeze actuator 48 to generate vibrations in the pressurized fluid according to a vibration pattern (such as described above). The squeeze actuator 48 provides the vibrations to the fluid by squeezing the tubing 43 according to the vibration pattern.

While specific embodiments have been described, the skilled person will understand that various modifications and alterations are conceivable within the scope as defined in the appended claims.

For example, even though only vibrations generated by fluid pressure are described with reference to the drawings, it will be appreciated that the vibrations may equally be generated by other means, such as by a motor with an eccentric weight positioned in, or in proximity to, the stimulation member, by electroactive material or any other convenient vibration generating means.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method of treatment of a human subject, comprising the steps of:

introducing a stimulation member into a nasal cavity of a human subject, said stimulation member being adapted to impart vibrations to body tissue of the human subject;

anchoring the stimulation member to the head of the human subject by means of at least one of a head band, a facial mask, a pair of glasses, and a helmet;

selecting a first frequency by: imparting vibrations to said nasal cavity at a variable frequency;

gradually adjusting the variable frequency up to a maximum frequency;

monitoring a bodily response to the treatment, the bodily response being indicative of a physiological condition of the subject;

determining the first frequency based on the monitored bodily response; and imparting vibrations to the nasal cavity of the human subject according to a vibration pattern, wherein the vibration pattern comprises a main periodic element with the first frequency and an excitation stimulus with a second frequency higher than the first frequency, and the second frequency is within a range of 1.5-5 times as high as the first frequency, wherein the vibrations are generated by one or more of:

an electroactive material, wherein the stimulation member comprises said electroactive material, the electroactive material being controlled such that the stimulation member vibrates according to the vibration pattern; and a vibration generator comprising a frequency regulating module configured to provide vibrations according to the vibration pattern to a pressurized fluid in the stimulation member, and wherein the step of monitoring a bodily response further comprises one or more of the steps of measuring a bodily response selected from a list comprising: nasal secretion, sneeze frequency, pain sensation, pupil size.

2. The method according to claim 1, wherein the first frequency is within a range of 10-100 Hz.

3. The method according to claim 1, wherein the vibration pattern has a continuous waveform.

4. The method according to claim 1, wherein the main periodic element is provided by a main stimulus of the first frequency, wherein the main stimulus is at least partly superposed with the excitation stimulus.

5. The method according to claim 1, wherein the main periodic element is provided by a vibration profile repetitively initiated at the first frequency, the vibration profile comprising a stimulation phase including the excitation stimulus and a rest phase.

6. The method according to claim 5, wherein the rest phase has at least a same duration as the stimulation phase.

7. The method according to claim 1, wherein the step of introducing the stimulation member to the nasal cavity further comprises: expanding the stimulation member to a volume such that the stimulation member abuts against body tissue in the nasal cavity at a pressure in a range of from 50 to 120 mbar.

8. The method according to claim 1, wherein the first frequency is within a range from of 50 to 70 Hz and the second frequency is within a range of from 110 to 320 Hz.

9. The method according to claim 1, further comprising the step of selecting the second frequency by:

gradually adjusting a frequency of the excitation stimulus from a value of the selected first frequency up to the maximum frequency;

monitoring, by a measuring device, a bodily response to the treatment, the bodily response being indicative of a physiological condition of the subject; and setting the second frequency to a frequency within ±10 Hz of a value of the frequency of the excitation stimulus at which the bodily response monitored during gradually adjusting the frequency of the excitation stimulus, is maximized.

10. The method according to claim 1, wherein the stimulation member is expandable and the step of introducing further comprises: expanding the stimulation member to a volume such that the stimulation member abuts against body tissue in the nasal cavity.

11. The method according to claim 1, wherein the vibrations are generated by the electroactive material, and the stimulation member comprises said electroactive material, the electroactive material being controlled such that the stimulation member vibrates according to the vibration pattern.

12. The method according to claim 11, wherein the electroactive material is a dielectric elastomer.

* * * * *